US007934933B2

(12) United States Patent
Busse

(10) Patent No.: US 7,934,933 B2
(45) Date of Patent: May 3, 2011

(54) PRINTED CIRCUIT BOARD PLUG-TYPE CONNECTOR AND CONNECTION MODULE WITH PRINTED CIRCUIT BOARD PLUG-TYPE CONNECTOR

(75) Inventor: Ralf-Dieter Busse, Hoppegarten (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/524,204

(22) PCT Filed: Dec. 13, 2007

(86) PCT No.: PCT/EP2007/010930

§ 371 (c)(1),
(2), (4) Date: Jul. 23, 2009

(87) PCT Pub. No.: WO2008/089824

PCT Pub. Date: Jul. 31, 2008

(65) Prior Publication Data

US 2010/0099308 A1 Apr. 22, 2010

(30) Foreign Application Priority Data

Jan. 23, 2007 (DE) ..... 10 2007 003 250

(51) Int. Cl.
*H01R 12/00* (2006.01)

(52) U.S. Cl. ..... 439/65; 439/62; 439/362

(58) Field of Classification Search ..... 439/65, 439/62, 362, 359

See application file for complete search history.

(56) References Cited

U.S. PATENT DOCUMENTS

| | | | | |
|---|---|---|---|---|
| 6,431,876 | B1 * | 8/2002 | Svenkeson et al. | 439/67 |
| 6,976,848 | B2 * | 12/2005 | Choi | 439/61 |
| 7,045,891 | B2 * | 5/2006 | Choi | 257/723 |
| 7,407,389 | B2 | 8/2008 | Busse et al. | |
| 7,473,100 | B2 * | 1/2009 | Moritake | 439/62 |
| 7,488,180 | B2 * | 2/2009 | Liu et al. | 439/65 |
| 2008/0247112 | A1 | 10/2008 | Benedetto | |

FOREIGN PATENT DOCUMENTS

| | | |
|---|---|---|
| DE | 2 104 406 | 12/1971 |
| DE | 7127805 | 1/1972 |
| DE | 102 57 308 | 7/2004 |
| DE | 103 39 844 | 1/2005 |
| DE | 10 2005 042 163 | 3/2007 |
| EP | 0 987 905 | 3/2000 |
| WO | WO 00/64194 | 10/2000 |
| WO | WO 2006/092553 | 9/2006 |

OTHER PUBLICATIONS

Office Action from related Chinese Patent Application No. 200780050367.2; dated Jan. 19, 2011 and English translation thereof.

* cited by examiner

*Primary Examiner* — Gary F. Paumen
(74) *Attorney, Agent, or Firm* — Merchant & Gould P.C.

(57) ABSTRACT

The invention relates to a printed circuit board plug-type connector (1), comprising a housing, in which contact elements (6) are arranged, wherein the contact elements (6) have a first contact part at one end and a second contact part at the opposite end, wherein the first contact part is in the form of a fork contact (7, 8), wherein the second contact part is in the form of a contact which makes contact with the printed circuit board, and an associated connection module (30) with a printed circuit board plug-type connector (1).

4 Claims, 4 Drawing Sheets

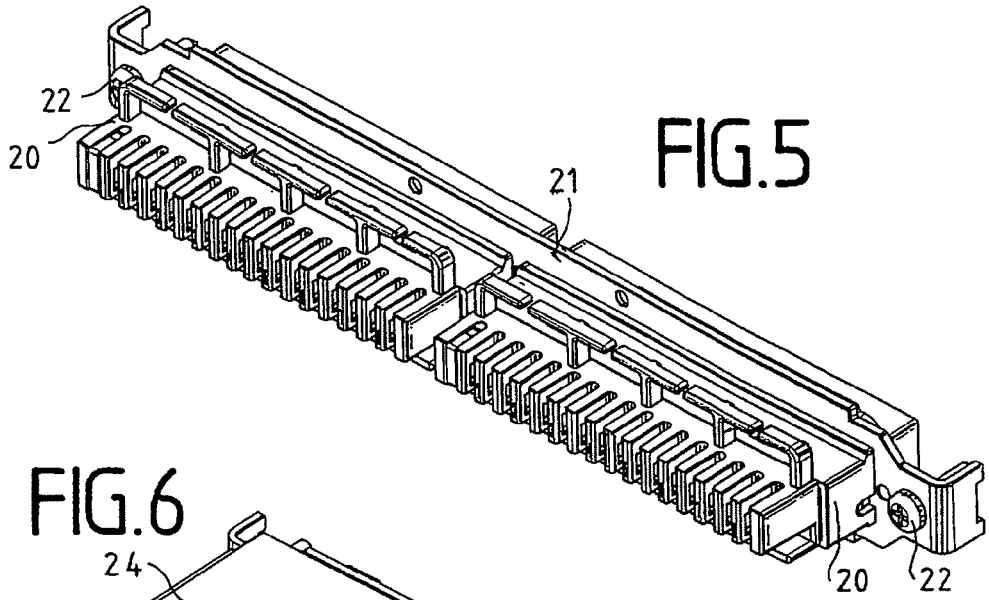
FIG.5
FIG.6
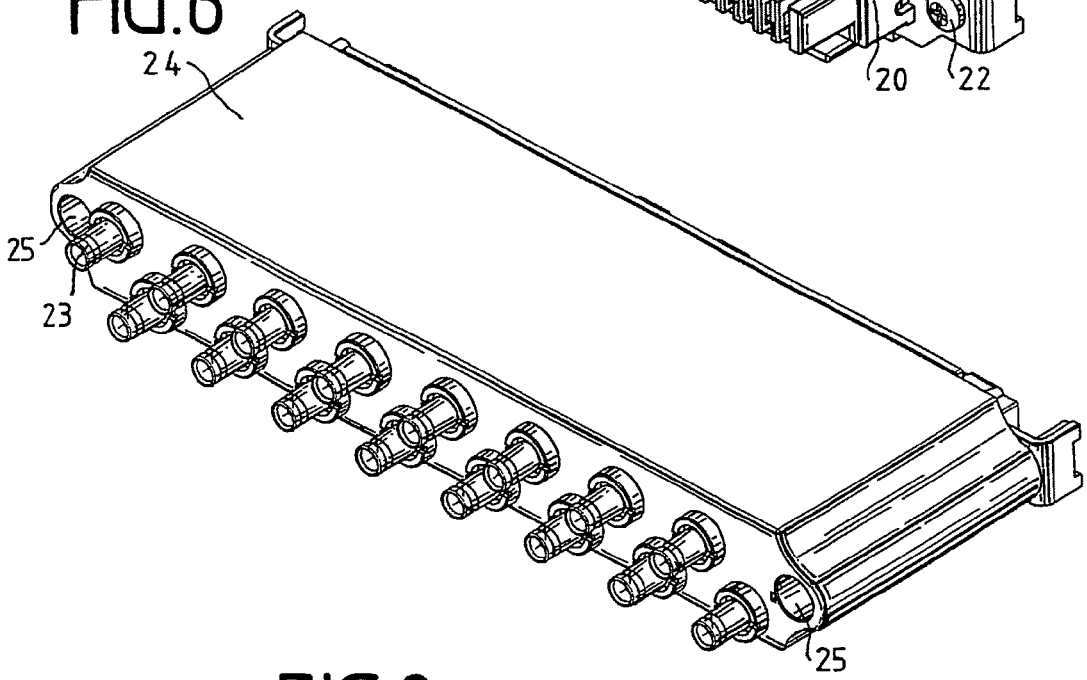
FIG.8
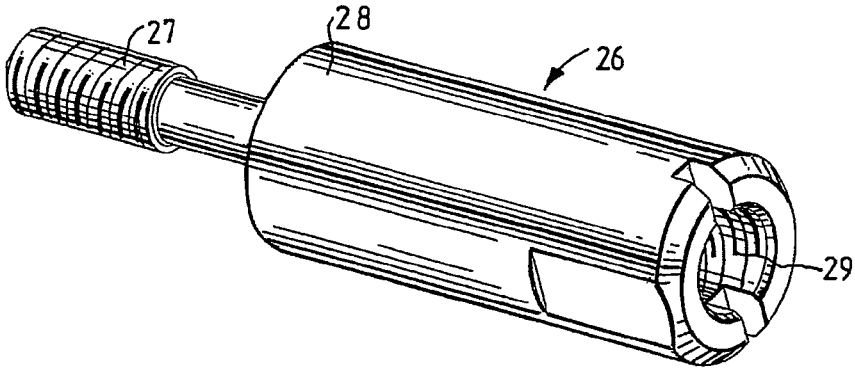

PRINTED CIRCUIT BOARD PLUG-TYPE CONNECTOR AND CONNECTION MODULE WITH PRINTED CIRCUIT BOARD PLUG-TYPE CONNECTOR

This application is a National Stage Application of PCT/EP2007/010930, filed 13 Dec. 2007, which claims benefit of Serial No. 10 2007 003 250.3, filed 23 Jan. 2007 in Germany and which applications are incorporated herein by reference. To the extent appropriate, a claim of priority is made to each of the above disclosed applications.

BACKGROUND

The invention relates to a plug-in connector for printed circuit boards with a connection module with plug-in connector for printed circuit boards.

Such a plug-in connector of the generic type is known, for example, from DE 102 57 308 B3. The plug-in connector for printed circuit boards comprises a number of contact elements, the contact elements each having two connection sides, one connection side being in the form of an insulation displacement contact for connecting wires, and the other connection side being in the form of a fork contact for making contact with connection pads on a printed circuit board, and a plastic housing, into which the insulation displacement contacts of the contact elements can be plugged, the insulation displacement contact and the fork contact being arranged such that they are turned towards one another, and at least one lower edge of the insulation displacement contact being supported on the plastic housing so that the contact elements are held in the plastic housing such that they cannot become detached in the case of connection forces occurring on the insulation displacement contacts, the plastic housing comprising at least one region in the form of a chamber, and the fork contacts being completely accommodated in the longitudinal direction by the plastic housing, ribs being arranged in the region in the form of a chamber on the inner sides, which ribs define guides for the fork contacts, the contact regions of the fork contacts protruding beyond the ribs, and the ribs being beveled in the front region. The packing density is in this case largely determined by the modular spacing between the fork contacts, which is in the region of a few millimeters.

One preferred application area of such plug-in connectors for printed circuit boards is the use in connection modules. Such a connection module comprises a housing, in which at least one printed circuit board is arranged, the plug-in connector for printed circuit boards then being pushed onto one end side of the printed circuit board. The printed circuit boards of such a connection module generally represent high-quality technology, with the result that it is endeavored to change as little as possible of this technology. On the other hand, there are also requirements when the cables to be connected are not in the form of twisted pairs but have plug-in connectors or connection contacts of various types such as, for example, RJ45 plugs or coaxial plugs.

SUMMARY

The object is therefore based on the technical problem of providing a plug-in connector for printed circuit boards and a connection module, by means of which flexibly various cable connections are possible.

In this regard, the plug-in connector for printed circuit boards comprises a housing, in which contact elements are arranged, the contact elements having a first contact part at one end and a second contact part at the opposite end, the first contact part being in the form of a fork contact, and the second contact part being in the form of a contact which makes contact with printed circuit boards. As a result, the printed circuit board including its interface can remain unchanged, a universal interface being created by the contact which makes contact with printed circuit boards. A printed circuit board with desirable connection contacts such as, for example, RJ45, Lemo, coaxial or wire-wrap contacts can be connected via the contact which makes contact with printed circuit boards in order to connect cables or wires. Likewise, a printed circuit board for a system test, for example, can be connected.

In this case, the contact which makes contact with printed circuit boards is preferably also in the form of a fork contact.

In a further preferred embodiment, the contact element is designed to be symmetrical, which in particular facilitates manipulation and fitting. The contact element can in this case be designed to be mirror-symmetrical with respect to the longitudinal axis of the contact element or else centrosymmetrical with respect to the center of gravity.

In a further preferred embodiment, the housing of the plug-in connector for printed circuit boards is designed to have two parts.

The plug-in connector for printed circuit boards is preferably in the form of a separate, independent component. However, it is also possible to integrate the plug-in connector for printed circuit boards together with an adapter printed circuit board and the associated connection contacts in a housing as a compact component.

In the case in which the plug-in connector for printed circuit boards is in the form of a separate component, the adapter printed circuit board with the connection contacts is preferably likewise arranged in a separate housing.

In order to connect the housing with the adapter printed circuit board, said housing preferably has a cylindrical cavity on each side, with the result that the housing can be connected to the housing of the connection module by means of a screw.

In the case of the design of the plug-in connector for printed circuit boards, the adapter printed circuit board and the associated contacts as a common, compact component, the connection to the housing of the connection module can take place by means of a long screw, which is guided through the cylindrical cavity. In the case of a separate design, on the other hand, at first the plug-in connector for printed circuit boards is connected by a first screw, this screw having an internal thread on the side facing the adapter printed circuit board, into which internal thread a second screw, which is guided through the cylindrical cavity, is then screwed.

BRIEF DESCRIPTION OF THE DRAWINGS

The invention will be explained in more detail below with reference to a preferred exemplary embodiment. In the figures:

FIG. 5 shows a perspective illustration of a plug-in connector for printed circuit boards with a front frame panel (prior art), FIG. 6 shows a perspective illustration of a housing with an adapter printed circuit and a coaxial plug-in connector, FIG. 8 shows a schematic, perspective illustration of a screw with an internal thread.

DETAILED DESCRIPTION

Figure 1:
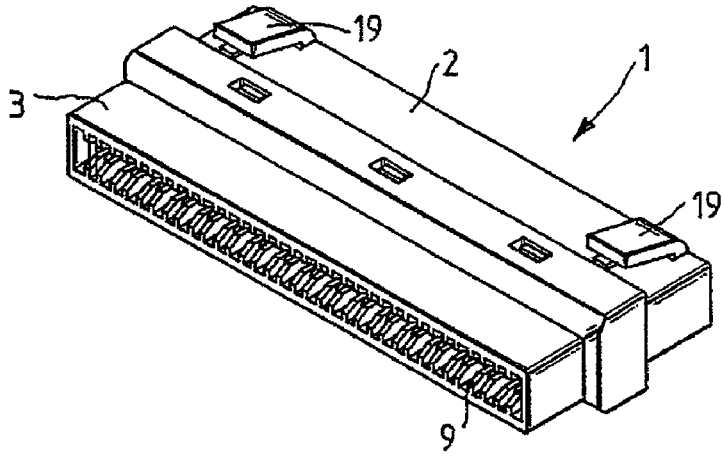
FIG. 1 shows a perspective illustration of a plug-in connector for printed circuit boards in the assembled state.
Figure 2:
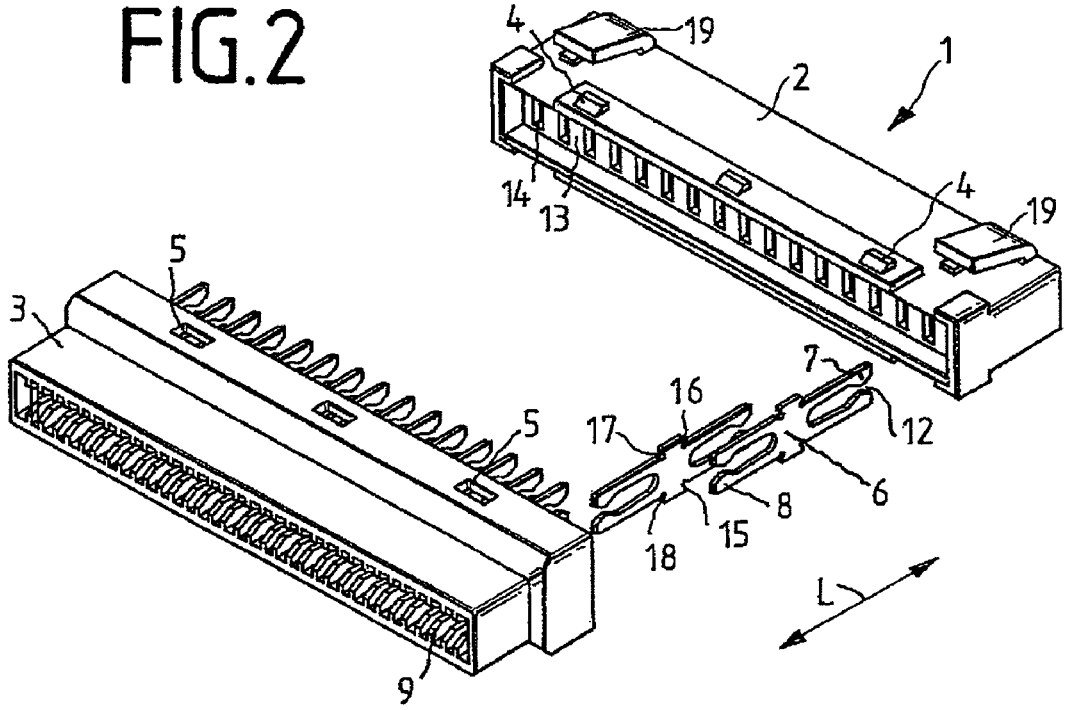
FIG. 2 shows a perspective, exploded illustration of the plug-in connector for printed circuit boards as shown in FIG. 1.

FIG. 1 shows the plug-in connector 1 for printed circuit boards in a perspective view and in the assembled state, and FIG. 2 shows it in an exploded illustration. The plug-in connector 1 for printed circuit boards comprises a first housing part 2 and a second housing part 3, which are latched to one another. For this purpose, the first housing part 2 has three latching tabs 4 on the upper side which latch into corresponding latching openings 5 in the second housing part. Correspondingly, three latching tabs 4 are also arranged on the lower side of the first housing part 2, and three further latching openings 5 are provided on the lower side of the second housing part 3. Contact elements 6, which are in the form of a twin-fork contact, are arranged in the housing of the plug-in connector 1 for printed circuit boards. The first fork contact 7 is in this case used for making contact with a printed circuit board 10 (see FIG. 3 or 4) of a connection module, while the second fork contact 8 is used for making contact with an adapter printed circuit board 11 or a measurement printed circuit board (see FIG. 4). Ribs 9, which in each case guide the fork contact 7, 8, are arranged both in the first and in the second housing part 2, 3. The contact regions 12 of the fork contacts 7, 8 in this case protrude beyond the ribs 9, the ribs 9 being beveled in the front region in order to make it easier for the printed circuit board 10, 11 to be pushed on. At the rear sides 13, the housing parts 2, 3 have entry slots 14, through which the fork contacts 7, 8 are plugged. In this case, the stop edges 15, 16 or 17, 18 are used for plugging the fork contacts 7, 8 in a defined manner and rest on the housing parts 2, 3 in front of the entry slots 14. In this case, the contact element 6 is designed to be symmetrical with respect to the central longitudinal axis L. Finally, the first housing part is formed in each case on the upper and lower side with two latching hooks 19.

Figure 3:
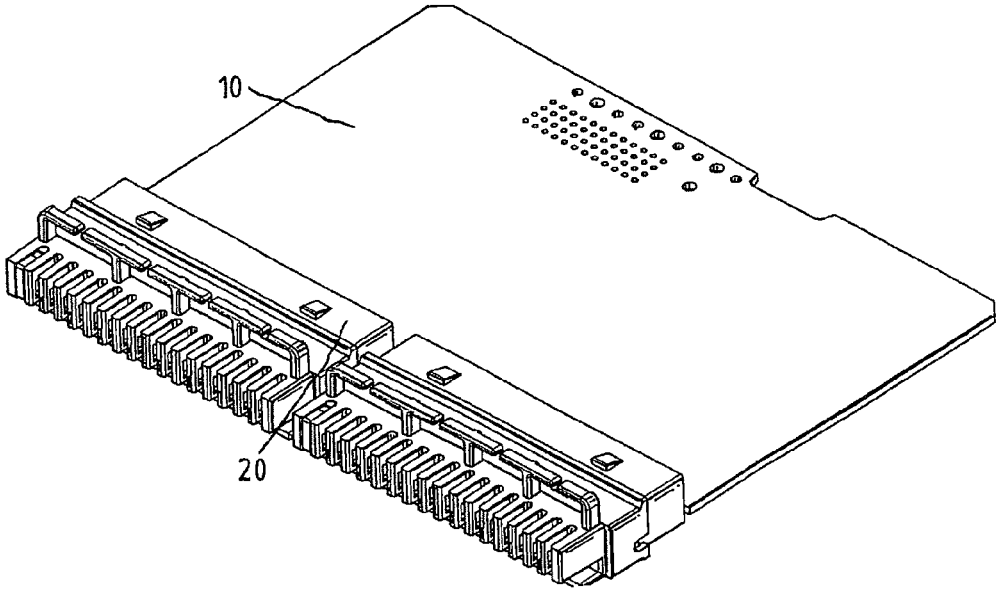
FIG. 3 shows a perspective illustration of two 17-pole plug-in connectors for printed circuit boards with a printed circuit board of a connection module (prior art)

FIG. 3 illustrates the situation in which two 17-pole plug-in connectors 20 for printed circuit boards in accordance with DE 102 57 308 B2 have been plugged onto a printed circuit board 10 of a connection module 30, in supplementary fashion to this FIG. 5 showing a front frame panel 21, onto which the plug-in connector 20 for printed circuit boards is latched, the front frame panel 21 and therefore also the plug-in connector 20 for printed circuit boards being screwed to a housing 31 of a connection module 30 by means of two screws 22. If, for example, the plug-in connector 20 for printed circuit boards with insulation displacement contacts is now intended to be replaced by another connection technique, the plug-in connector 20 is withdrawn from the printed circuit board 10 and replaced by a plug-in connector 1 for printed circuit boards, the fork contacts 7 having the same modular spacing as the fork contacts of the plug-in connector 20.

Figure 4:
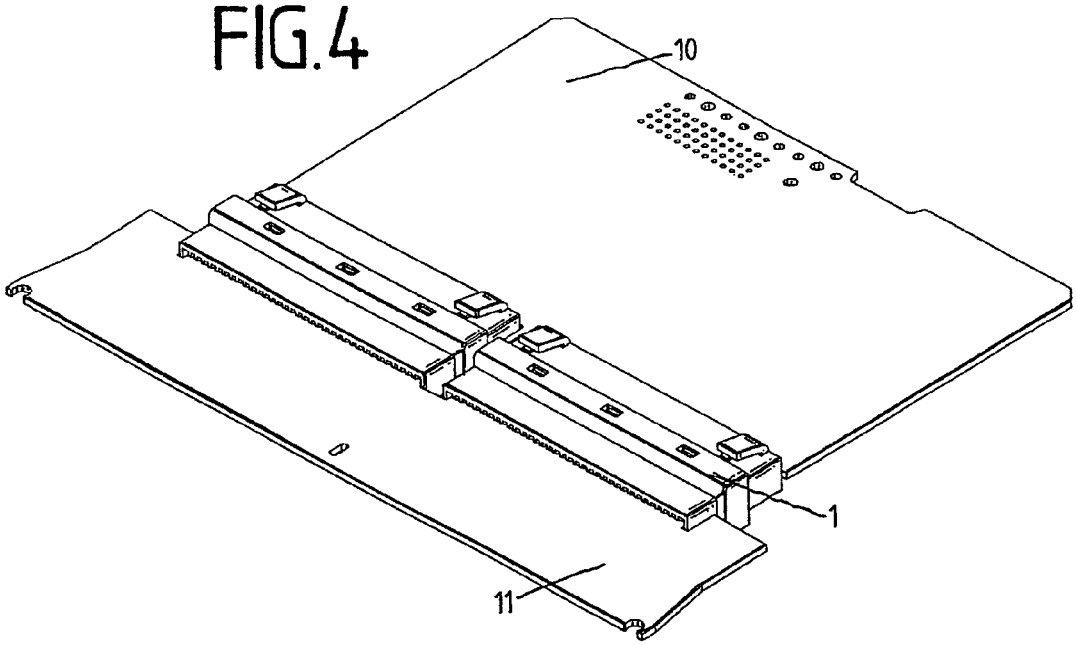
FIG. 4 shows a perspective illustration of two 17-pole plug-in connectors for printed circuit boards with adapter printed circuit boards.

FIG. 4 illustrates the plug-in connector 1 for printed circuit boards according to the invention, whose fork contacts 7 have been fitted onto the printed circuit board 10 of a connection module 30 and whose fork contacts 8 have been fitted onto an adapter printed circuit board 11. Then, desired plug-in connectors or connection contacts are arranged on the adapter printed circuit board 11 and are then guided via conductor tracks to contact pads, which then make contact with the fork contacts 8. FIG. 6 illustrates this for coaxial plug-in connectors 23, the adapter printed circuit board 11 with the coaxial plug-in connectors 23 being arranged in a separate housing 24. Cylindrical cavities 25 are provided laterally on the housing 24.

A preferred connection to the connection module 30 now takes place by virtue of the fact that, at first, the plug-in connector 1 for printed circuit boards with the front frame panel 21 is screwed to the housing 31 of the connection module 30 by means of a screw 26 (see FIG. 8). The screw 26 has, for this purpose, a first thread 27, which is matched to the housing of the connection module. Furthermore, the screw 26 has, on the opposite side, an elongate head 28, which is formed with an internal thread 29. The head 28 is in this case matched to the cylindrical cavity 25. Then, the adapter printed circuit board 11 is plugged onto the fork contacts 8, the head 28 dipping into the cylindrical cavity. Then, a screw can be plugged into the cylindrical cavity 25 in front of the front side of the housing 24, the thread of said screw being matched to the internal thread 29. As a result, the housing 24 can then be connected indirectly to the housing of the connection module 30.

Figure 7:
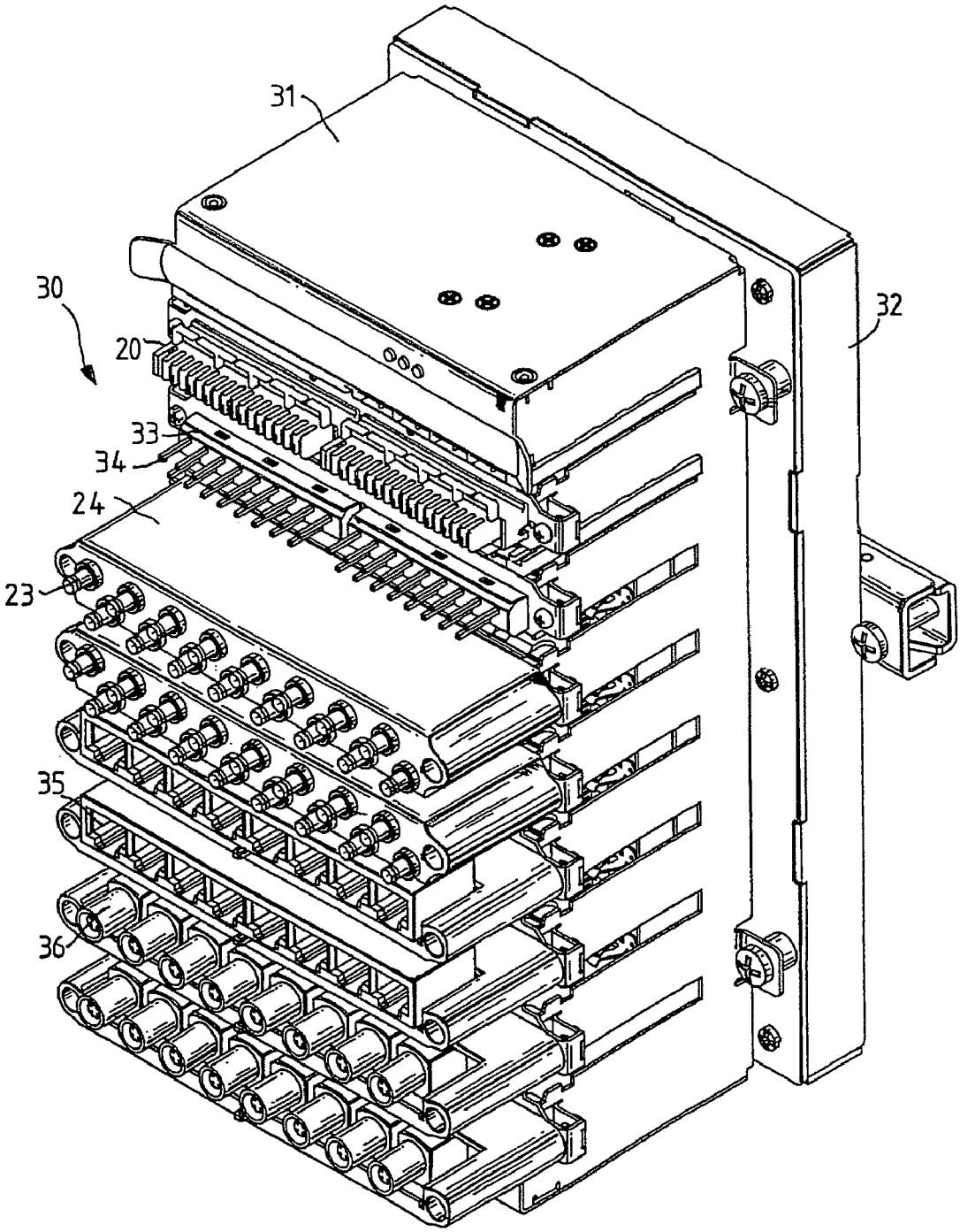
FIG. 7 shows a perspective illustration of a connection module.

Finally, FIG. 7 illustrates a fully equipped connection module 30, which has a housing 31 and a rear side 32 with active technology. In this case, various interfaces are provided on the rear side 32 for signals and supply voltages. In the uppermost row, there is a plug-in connector 20 for printed circuit boards which is formed with insulation displacement contacts. Beneath this, a further plug-in connector 33 for printed circuit boards with wire-wrap contacts 34 is arranged, whose design is not the subject matter of this invention. Beneath this, two housings 24 with adapter printed circuit boards 11 of a coaxial plug-in connector 23 are arranged (see FIG. 6). Correspondingly, beneath this embodiments for RJ45 sockets 35 and Lemo plug-in connectors 36 are shown, in the two latter variants the housing having a stepped design, i.e. being higher at the front than at the back.

LIST OF REFERENCE NUMERALS

1 Plug-in connector for printed circuit boards
2 First housing part
3 Second housing part
4 Latching tabs
5 Latching openings
6 Contact elements
7 First fork contact
8 Second fork contact
9 Rib
10 Printed circuit board
11 Adapter printed circuit board
12 Contact regions
13 Rear sides
14 Entry slots
15 Stop edge
16 Stop edge
17 Stop edge
18 Stop edge
19 Latching hooks
20 Plug-in connector for printed circuit boards
21 Front frame panel
22 Screws
23 Coaxial plug-in connector
24 Separate housing
25 Cylindrical cavity
26 Screw
27 Thread
28 Head

29 Internal thread
30 Connection module
31 Housing
32 Rear side
33 Plug-in connector for printed circuit boards
34 Wire-wrap contacts
35 RJ45 socket
36 Lemo plug-in connector
L Central longitudinal axis

The invention claimed is:

1. A connection module, comprising:

a module housing; and at least one printed circuit board mounted in the module housing; and a plug-in connector including a housing, in which contact elements are arranged, mounted to the module housing, the contact elements having a first contact part at one end and a second contact part at the opposite end, the first contact part being in the form of a fork contact, wherein the second contact part is in the form of a contact which makes contact with printed circuit boards, the plug-in connector being plugged onto the printed circuit board, and a further printed circuit board having connection elements for cables or wires being plugged onto the plug-in connector for printed circuit boards;

wherein the further printed circuit board is arranged in a separate housing, wherein the separate housing has a cylindrical cavity on each side, and wherein a screw is arranged in each cylindrical cavity and is screwed into an internal thread of a second screw, the second screw being screwed into the module housing of the connection module.

2. The connection module as claimed in claim 1, wherein the contact elements are symmetrical.

3. The connection module as claimed in claim 1, wherein the housing of the plug-in connector includes two parts.

4. The connection module as claimed in claim 1, wherein the second contact part is in the form of a fork contact.

* * * * *